US007892075B2

(12) United States Patent
Esenwein

(10) Patent No.: US 7,892,075 B2
(45) Date of Patent: Feb. 22, 2011

(54) HAND-HELD POWER TOOL FOR A ROTATING TOOL WITH GUARD

(75) Inventor: Florian Esenwein, Uhingen-Holzhausen (DE)

(73) Assignee: Robert Bosch GmbH, Stuttgart (DE)

( * ) Notice: Subject to any disclaimer, the term of this patent is extended or adjusted under 35 U.S.C. 154(b) by 188 days.

(21) Appl. No.: 12/278,847

(22) PCT Filed: Sep. 21, 2007

(86) PCT No.: PCT/EP2007/060046

§ 371 (c)(1),
(2), (4) Date: Aug. 8, 2008

(87) PCT Pub. No.: WO2008/058797

PCT Pub. Date: May 22, 2008

(65) Prior Publication Data

US 2009/0209184 A1 Aug. 20, 2009

(30) Foreign Application Priority Data

Nov. 13, 2006 (DE) ..... 10 2006 053 303

(51) Int. Cl.
*B24B 55/04* (2006.01)

(52) U.S. Cl. ..... 451/451; 451/344; 451/359; 451/452

(58) Field of Classification Search ..... 451/344, 451/357, 358, 359, 451, 452, 454, 455
See application file for complete search history.

(56) References Cited

U.S. PATENT DOCUMENTS 4,060,940 A * 12/1977 DeWitt ..... 451/358
4,574,532 A * 3/1986 Haberle et al. ..... 451/451
4,791,541 A * 12/1988 Simmons ..... 362/376
4,924,635 A * 5/1990 Rudolf et al. ..... 451/344
5,005,321 A * 4/1991 Barth et al. ..... 451/359
5,384,985 A * 1/1995 Jacobsson ..... 451/344
5,440,815 A * 8/1995 Inkster ..... 30/390
5,766,062 A * 6/1998 Edling ..... 451/451
6,464,573 B1 * 10/2002 Keller ..... 451/451
6,669,544 B1 * 12/2003 Walz et al. ..... 451/454
6,699,114 B1 * 3/2004 Booeshaghi et al. ..... 451/451
6,893,334 B1 * 5/2005 Stivers ..... 451/359
6,949,017 B2 * 9/2005 Koschel et al. ..... 451/358
6,988,939 B2 * 1/2006 Hofmann et al. ..... 451/344

(Continued)

FOREIGN PATENT DOCUMENTS

DE 102 59 520 7/2004

(Continued)

*Primary Examiner*—Eileen P. Morgan
(74) *Attorney, Agent, or Firm*—Michael J. Striker

(57) ABSTRACT

A hand-held power tool for a rotating tool has a machine housing with a machine neck, a guard for at least partially covering the tool and detachably attached to the machine neck and including a guard neck, a clamping cuff for detachably attaching the guard to the machine neck, and an engagement structure including an engagement element provided on the clamping cuff and at least one recess for engagement of the engagement element provided on the guard neck, or on the guard neck and the machine neck, to form a rotational lock that acts between the machine neck and guard, and the clamping cuff is a separate component attached to the machine housing.

16 Claims, 3 Drawing Sheets

U.S. PATENT DOCUMENTS

| | | | | |
|---|---|---|---|---|
| 7,063,606 | B2 * | 6/2006 | Stierle et al. | 451/359 |
| 7,311,589 | B2 * | 12/2007 | Wiker | 451/451 |
| 2004/0014412 | A1 * | 1/2004 | Hofmann et al. | 451/451 |
| 2006/0052041 | A1 * | 3/2006 | Wiker | 451/451 |

FOREIGN PATENT DOCUMENTS

| | | |
|---|---|---|
| WO | 2004/087377 | 10/2004 |

* cited by examiner

HAND-HELD POWER TOOL FOR A ROTATING TOOL WITH GUARD

CROSS-REFERENCE TO A RELATED APPLICATION

The invention described and claimed hereinbelow is also described in German Patent Application DE 10 2006 053 303.8 filed on Nov. 13, 2006. This German Patent Application, whose subject matter is incorporated here by reference, provides the basis for a claim of priority of invention under 35 U.S.C. 119(a)-(d).

BACKGROUND OF THE INVENTION

The present invention relates to a hand-held power tool for a rotating tool with a guard.

Hand-held power tools for rotating, preferably disk-shaped tools are known. They are used in diverse applications, e.g., as angle grinders. Hand-held power tools of these types include guards, which serve to ensure that sparks and material particles—which are slung off of the rotating tool, e.g., grinding or cutting disks, during operation of the hand-held power tool—do not reach the operator and/or the surroundings. The guard also serves to protect the operator and the surroundings if the tool should become destroyed. It is possible for a cutting disk to burst in a work piece if it becomes tilted while rotating. The guard must ensure that fragments of the burst cutting disk, some of which are slung off with high energy, are kept away from the operator. In general, the guards cover the work piece only in segments, however, e.g., in an angular range of approximately 180°, in order to provide the operator with freedom to work with the rotating tool and the work piece. To enable the guard to be rotated in the desired range, it is known per the related art to attach the guard in a detachable manner, e.g., using a clamping band located on the guard. Various designs are known to accomplish this, with which the circumference of a clamping band is expanded and constricted by releasing and tightening a clamping screw, thereby enabling the guard to be retained on the machine neck via a clamping effect. Adjusting the guard is a complicated procedure, however, and requires a tool. Under certain circumstances, the operator therefore often forgoes adjusting the guard properly. The guard is therefore not positioned on the collar of the machine in an optimal manner. Publication DE 102 59 520 A1, for example, therefore makes known to provide a clamping cuff on the guard, the circumference of which is adjustable using a lever (clamping lever), thereby enabling the guard to be released from its locked position using a simple lever motion so that it may be rotated around the collar. Recesses are formed in the machine collar in which a pawl mounted on the clamping band and/or the clamping lever of the clamping band engage in order to lock the guard in certain angular positions after the guard has been swiveled relative to the hand-held power tool. A disadvantage of this is that the guard fits only one type of hand-held power tool, with the pawl being formed on the guard. In addition, the absorption of force that occurs if the tool bursts is often inadequate.

SUMMARY OF THE INVENTION

The object of the present invention is to provide a refinement that avoids the disadvantages stated above and provides greater protection and comfort for the operator of the hand-held power tool.

To this end, a hand-held power tool for a rotating, preferably disk-shaped tool is provided, that includes a machine housing with a machine neck, to which a guard for at least partially covering the tool is detachably connected. The guard includes a guard neck and is provided for the detachable attachment of a clamping cuff. An engagement element is formed on the clamping cuff, and at least one recess for engagement of the engagement element is located/formed on the guard neck or on the guard neck and the machine neck, for forming a rotational lock that acts between the machine neck and the guard. The guard is therefore a separate component from the hand-held power tool, and the clamping cuff is a separate component from the guard. The guard includes a guard neck that is attached to the machine housing, in particular being slipped over the machine neck formed on the machine housing, and that may be released therefrom, with the clamping cuff serving for attachment of the guard neck. To this end, the clamping cuff includes an engagement element that may interact with at least one recess in the guard neck or in the guard neck and the machine neck. When this engagement element engages in the recess, the guard is prevented from rotating on the machine neck, since the engagement element extends through the guard neck, or it passes through the guard neck and also engages in a recess formed in the machine neck. The guard neck is therefore locked in position in the at least one recess via the engagement with the engagement element.

In a further embodiment, the clamping cuff is designed as a separate component and is attached to the machine housing. The fact that the clamping cuff and the fastening to the machine housing are designed to be separate allows the guard to be freed from the clamping mechanism as such. The guard is therefore easier to handle, and this design makes it possible to use the clamping cuff in a certain, defined manner and, e.g., to attach it to the machine housing independently of the position of the guard relative to the machine housing.

In a further preferred embodiment, the guard neck is enclosed by the clamping cuff. The clamping cuff therefore encloses the guard neck more or less entirely, depending on whether the clamping cuff is designed as a closed ring or an open ring, thereby ensuring that the guard is attached via the guard neck, which is attached thereto.

According to a further embodiment, it is provided that the guard neck encloses the machine neck entirely or partially. Depending on its design, the guard neck therefore encloses the machine neck entirely or at least in sections. This results in a great deal of freedom as to how the guard is to be positioned relative to the machine housing, in particular with the design that provides partial enclosure.

In a preferred embodiment, it is provided that the machine neck and/or the guard neck include(s) a compensating element, in particular a ring made of an elastic material, in particular rubber, to compensate for tolerances between the guard neck and the machine neck. Using this compensating element, it is possible to compensate for any tolerances between the machine neck and/or the guard neck and/or the clamping cuff, and, in particular, to ensure that the parts have adequate large-area contact with each other.

In a further embodiment, the guard neck is designed as an annular element or an annular-segment element. When designed as an annular element, the guard neck is located on the guard in an annular manner, in particular concentrically with the outer circumference of the circular segment that is covered by the guard. When designed as an annular-segment element, the guard neck is designed as a partial ring, and not as an entire ring, and preferably such that it covers the angular range that is also covered by the guard itself. This results in a particularly great deal of freedom in terms of the positioning and locking of the guard relative to the machine housing.

In another embodiment, it is provided that the clamping cuff includes a clamping device whose diameter decreases when it is tightened. This clamping device may be designed, e.g., as a screw with a counter-thread, with the clamping cuff being designed as an open ring that is closed by the clamping device.

In a further embodiment, it is provided that the clamping cuff includes an engagement element and a clamping device. The engagement element and the engagement device are therefore different components. The engagement element serves to secure the guard against axial rotation on the machine neck, while the clamping device serves to provide fixation in general, in particular against sliding off of the machine neck.

In a further embodiment, it is provided that the clamping device is designed as a lever that includes the engagement element. The circumference of the clamping cuff is therefore increased and decreased using a lever that is already known from the related art, which opens or closes the clamping cuff, which is designed as an open ring. The lever includes the engagement element, which, in particular, is formed on the underside of the lever or is located thereon.

In a preferred embodiment, the lever is spring-loaded in order to lock in the engagement position of the engagement element. The engagement element located on the lever is therefore always engaged with the at least one recess, provided that the lever is opened against the force of the spring. This ensures that the guard may not be accidentally displaced or removed, since firm action must be taken to oppose the spring action, and, for example—but not necessarily—the clamping device may be opened at the same time.

In a further embodiment, the engagement element is located on an engagement lever, and the clamping device is actuatable using a clamping lever. As a modification of the embodiment described above, the engagement element therefore includes a separate engagement lever that only actuates the engagement element, without simultaneously actuating the clamping device. The clamping device is actuated in a different manner, e.g., using a clamping lever.

In a further embodiment, the engagement element is a screw. This embodiment is recommended, in particular, for designs with which the guard is to be adjusted with a tool, and/or with which it is not necessary that the guard be adjusted frequently relative to the machine housing. The design with a lever-actuated engagement element is therefore not necessary, either.

In a further, particularly preferred embodiment, the rotation lock is formed via the engagement element and via a series of recesses located in the guard neck or in the guard neck and machine neck, as an adjustable rotation lock of the guard relative to the machine neck. By forming a series of recesses in which the engagement element may engage selectively and/or sequentially, a rotation lock of the guard relative to the machine neck and, therefore, to the machine housing may be formed, in any position that is specified by the series of recesses. The guard may be fixed in position in the particular recess simply by allowing the engagement element to engage.

In a further embodiment, it is provided that the clamping cuff includes at least one fastening tab, which preferably extends in the radial direction and serves for attachment to the machine housing. A fastening tab of this type may be designed as a single piece with the clamping cuff, or it may be located thereon, in particularly being fastened thereto. In a preferred embodiment, the fastening tab extends in the radial direction and on the outside of the clamping cuff, and it includes a bore or another type of device to attach it and the clamping cuff—via said fastening tab—to the machine housing. Particularly preferably, the fastening tab is attached to the machine housing using screws, which are provided on the machine housing anyway in order to secure a transmission housing.

In a further, particularly preferred embodiment, a fastening groove that extends around at least a portion of the circumference is formed on the machine neck and interacts with at least one groove-engagement element formed/located on the guard neck to form a rotation lock for the guard. The groove-engagement element is therefore inserted into the fastening groove—which extends at least partially around the circumference—when the guard neck is attached to the machine neck, thereby preventing the guard from accidentally detaching from the machine neck and slipping off.

In a further preferred embodiment, the groove includes a groove inlet, in particular one that extends essentially perpendicularly to the groove, thereby enabling the groove-engagement element to be engaged in the groove in the simplest manner possible when the guard neck is slid onto the machine neck.

In a further preferred embodiment, the groove-engagement element is a cam, or it includes cams. They are particularly easy to manufacture, thereby making it possible to form them on the guard neck in a simple, economical manner.

Further advantageous embodiments result from the subclaims and combinations thereof.

BRIEF DESCRIPTION OF THE DRAWING

The present invention is explained below in greater detail below with reference to the drawing.

DESCRIPTIONS OF THE PREFERRED EMBODIMENTS

Figure 1:
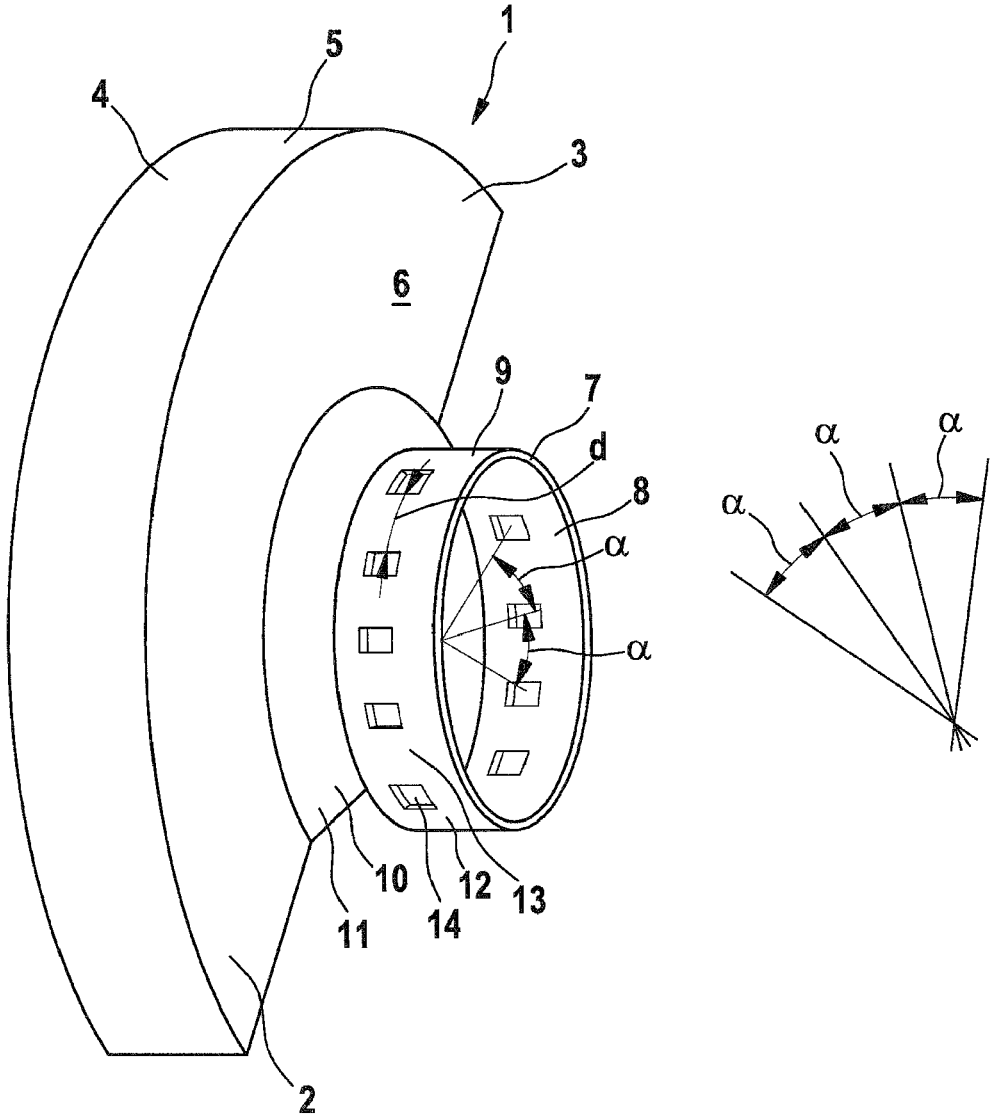
FIG. 1 shows a guard with a guard neck that includes a series of recesses.

FIG. 1 shows a guard 1 for a not-shown hand-held power tool, i.e., an angle grinder. Guard 1 is designed as a type of pot section 2, with a guard base 3 and a guard edge 4. Guard edge 4 is designed essentially as annular section 5. Guard base 3, which abuts annular section 5 on one side, essentially forms a semicircle 6. A guard neck 7 is formed concentrically with an assumed center point of semicircle 6, guard neck 7 including a guard wall, which extends essentially perpendicularly to guard base 3. Guard neck 7 is formed as a semicircle around the assumed center of semicircle 6. Guard neck 7 is designed as an annular element 9. A material reinforcement 10 and/or offset 11 are/is provided between guard base 3 and guard neck 7 to increase the stiffness and robustness. Guard neck 7 includes, distributed around its circumference 12, a series of openings 14, which are essentially equidistant, i.e., they are essentially separated by the same distance d. Starting from the assumed center of guard neck 7 (of annular element 9), the same angle (circle angle) $\alpha$ is formed by series 13 of openings 14, which are separated by distance d.

Figure 2:
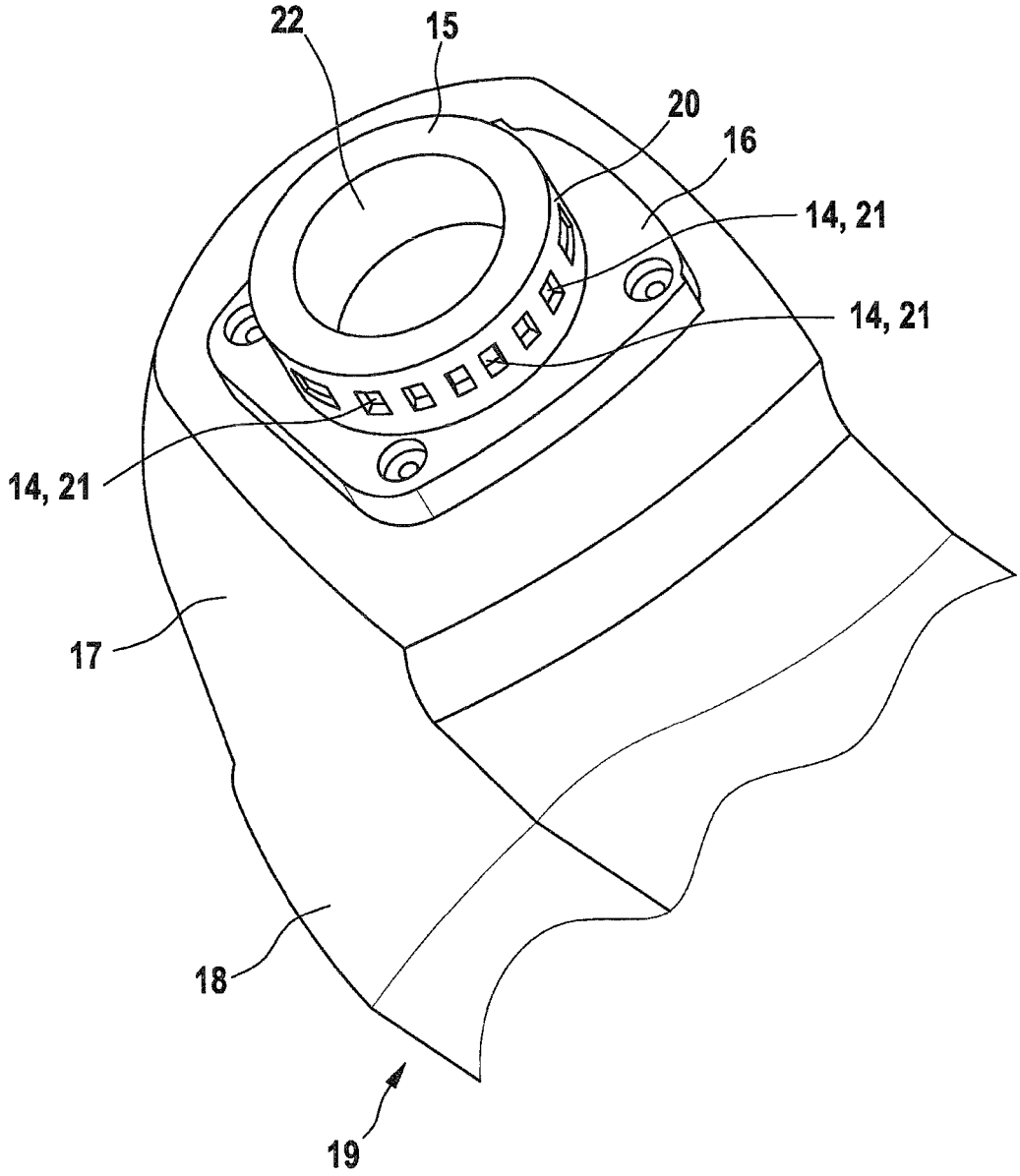
FIG. 2 shows a transmission cover with a machine neck formed thereon, the machine neck including a series of recesses.

FIG. 2 shows a machine neck 15, which is located on a transmission cover plate 16, in particular being formed as a single piece therewith. The transmission cover plate closes a bevel gear 17 of a machine housing 18 of hand-held power tool 19. Machine neck 15 includes a machine neck wall 20, in which a series of equidistant openings 14 is formed on the outer circumference. Openings 14 are designed as recesses 21 that do not pass through to machine neck inner side 22. Machine neck 15 accommodates a not-shown tool spindle for receiving a tool, which is to be covered with a not-shown guard.

Figure 3:
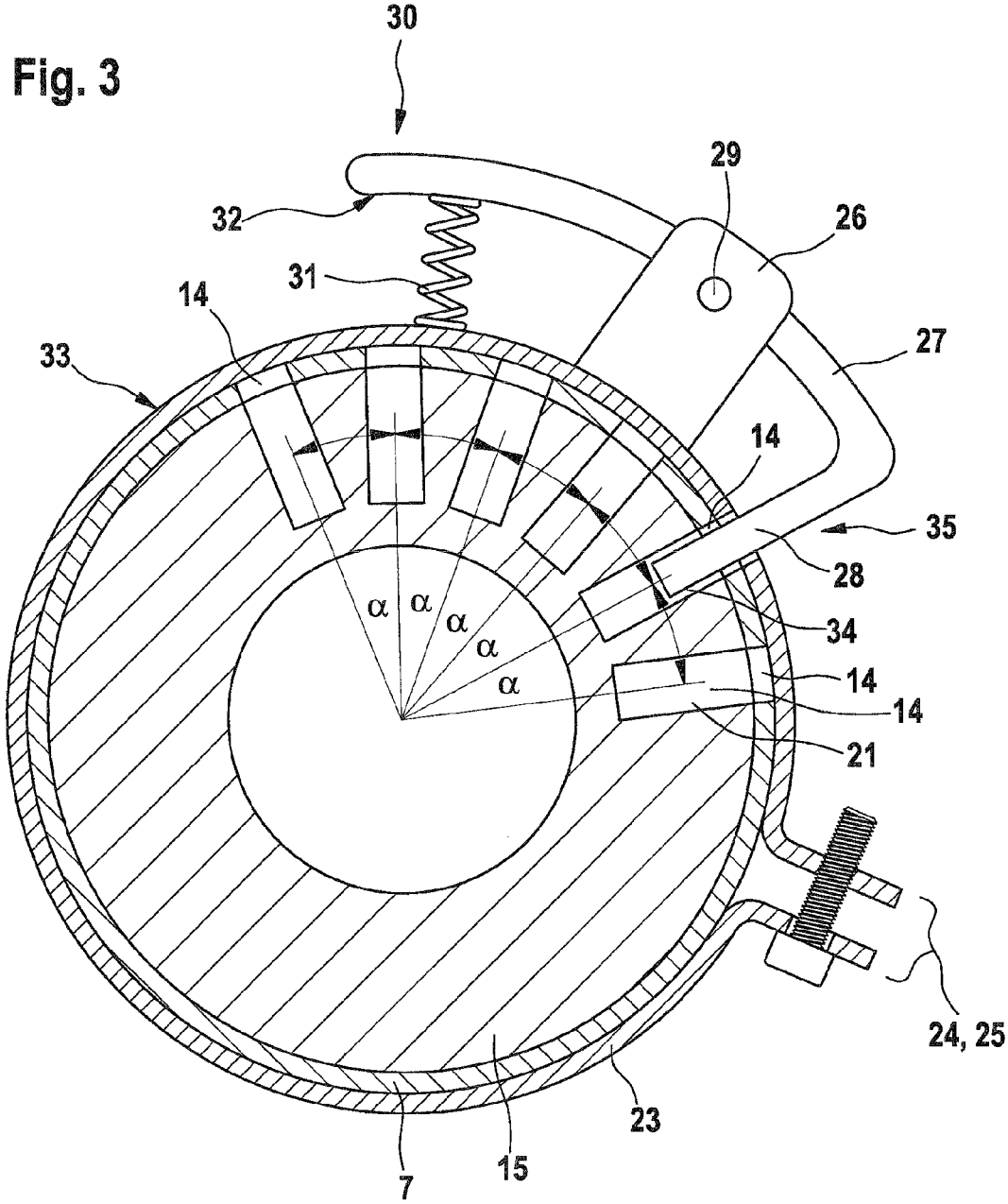
FIG. 3 shows a cross-sectional view of a machine neck in the installation state, enclosed by a guard neck and a clamping cuff.

FIG. 3 shows machine neck 15 and guard neck 7 that encloses it. FIG. 3 also shows clamping cuff 23, which encloses guard neck 7. Clamping cuff 23 includes a clamping device 24, the diameter of which may be decreased in order to provide an initial fixation. Clamping device 24 is depicted here basically as a screw-type clamping device 25. On the outer circumference of clamping cuff 23, a lever with an engagement element 28 formed on its end is supported in bearing tabs 26 such that it may rotate around a rotational axis 29 located perpendicularly inside bearing tabs 26. Openings 14 are located on machine neck 15 and, corresponding thereto, on guard neck 7, for purposes of interaction, i.e., for engagement of engagement element 28. Openings 14 basically lie on the same radii and start from an assumed center of machine neck 15, and therefore form the same sub-angle $\alpha$. Engagement element 28 may therefore pass through openings 14, with openings 14 in machine neck 15 being designed as recesses 21, i.e., not continuous, so that guard neck 7 is locked in place relative to machine neck 15. By releasing, i.e., removing engagement element 28 from recesses 14 by actuating an end region 30 of lever 27, guard neck 7 becomes movable in a rotating manner inside this configuration, so that it may be located at a different angular distance $\alpha$ relative to the other components, and so that it may be locked in place by releasing lever 27. To ensure that lever 27 and, therefore, engagement element 28 do not accidentally fall out of openings 14, lever 27 is spring-loaded at its end region 30. A helical compression spring 31 bears against an underside 32 of the lever end and on an outer circumference 33 of the clamping cuff. In the resting state, lever 27 is therefore located in a position due to the spring force of helical compression spring 31 such that engagement element 28 extends through openings 14 and into recesses 21, and the guard neck is fixed in position relative to the other components. The spring loading of lever 27 may be brought about, of course, using other suitable spring designs, e.g., leg-type compression springs or the like. Engagement element 28 forms a rotation lock 34 in interaction with openings 14. Rotation lock 34 serves—with series 13 of openings 14—as rotation lock device 35. Series 13 makes it possible to select defined angular positions of guard 1 relative to machine neck 15.

What is claimed is:

1. A hand-held power tool (19) for rotating a grinding tool, comprising: a machine housing (18) with a machine neck (15), a guard (1) for at least partially covering the tool, the guard (1) including a guard neck (7) and being detachably attached to the machine neck (15), a clamping cuff (23) for detachably attaching the guard (1) to the machine neck (15), the cuff having a decreasable diameter and having engagement means including an engagement element (28) provided on the clamping cuff (23), the cuff having at least one recess, the guard neck (7) having at least two recesses, the machine neck (15) having at least one recess, wherein the guard neck is rotated to a desired position about the machine neck and the engagement element (28) is passed through the recess of the cuff, one of the recesses of the guard neck, and the at least one recess of the machine neck to form a rotational lock (34) that acts between the machine neck (15) and guard (1), wherein the clamping cuff (23) having a decreasable diameter is a separate component attached to the machine housing (18).

2. The hand-held power tool as recited in claim 1, wherein the guard neck (7) is enclosed by the clamping cuff (23).

3. The hand-held power tool as recited in claim 1, wherein the guard neck (7) encloses the machine neck (15) completely or partially.

4. The hand-held power tool as recited in claim 1, wherein the machine neck (15) and/or the guard neck (7) includes a compensating element, in particular a ring made of an elastic material, in particular rubber, to compensate for tolerances between the guard neck (7) and the machine neck (15).

5. The hand-held power tool as recited in claim 1, wherein the guard neck (7) is designed as an annular element (9) or an annular segment.

6. The hand-held power tool as recited in claim 1, wherein the clamping cuff (23) includes a clamping device (24) whose diameter decreases when it is tightened.

7. The hand-held power tool as recited in claim 1, wherein the clamping cuff (23) includes the engagement element (28) and a clamping device (24).

8. The hand-held power tool as recited in claim 1, wherein the clamping cuff (23) has a lever (27) that includes the engagement element (28).

9. The hand-held power tool as recited in claim 1, wherein the lever (27) is spring-loaded in order to fix the engagement position of the engagement element (28).

10. The hand-held power tool as recited in claim 1, wherein the engagement element (28) is located on an engagement lever.

11. The hand-held power tool as recited in claim 1, wherein clamping cuff (23) has a clamping device (24), including a screw (25).

12. The hand-held power tool as recited in claim 1, wherein the clamping cuff (23) includes at least one fastening tab, which preferably extends in the radial direction and serves for attachment to the machine housing (18).

13. The hand-held power tool as recited in claim 1, wherein a fastening groove that extends around at least a portion of the circumference is formed on the machine neck (15) and interacts with at least one groove-engagement element formed/located on the guard neck (7) to form a rotation lock for the guard (1).

14. The hand-held power tool as recited in claim 13, wherein the groove includes a groove inlet.

15. The hand-held power tool as recited in claim 13, wherein the groove-engagement element is a cam or includes cams.

16. The hand-held power tool as recited in claim 13, wherein said engaging element extends substantially radially.

* * * * *